US005853107A

United States Patent [19]

Giwojna

[11] Patent Number: 5,853,107

[45] Date of Patent: Dec. 29, 1998

[54] LATCH ON PAINT CAN POUR SPROUT

[76] Inventor: John F Giwojna, N14952 Wilderness Ave., Thorp, Wis. 54771-7414

[21] Appl. No.: 859,442

[22] Filed: May 20, 1997

[51] Int. Cl.[6] ..... B65D 25/00

[52] U.S. Cl. ..... 220/733

[58] Field of Search ..... 220/733, 695, 220/697, 699, 701

[56] References Cited

U.S. PATENT DOCUMENTS

| | | | |
|---|---|---|---|
| 2,315,250 | 3/1943 | Eilers | 220/733 X |
| 2,683,553 | 7/1954 | Ariss | 220/699 X |
| 3,239,113 | 3/1966 | Knize | 220/733 X |
| 4,203,537 | 5/1980 | McAlister | 220/733 X |
| 4,911,319 | 3/1990 | DeJean | 220/733 X |
| 5,012,960 | 5/1991 | Arnold | 220/733 X |

*Primary Examiner*—Steven M. Pollard

[57] ABSTRACT

This invention provides a convenient way to pour paint (or other liquids) from a paint can. The invention is comprised of a pour spout device that fits, in saddle fashion, directly onto the inner ridge of a paint can, formally occupied by the paint can's lid, by means of a ridge groove seal device. The ridge groove seal device employs a synthetic rubber, press fit seal. The invention employs a simple hinged latch device to hold the pour spout device to the can by means of tension fit. The use of the hinged latch device makes the invention easy to mount and to remove. Once the invention is attached (latched) to a paint can, paint (or other liquid) is directed through the pour spout, which consists of a curved metal lip that extends out from the top edge of the can and which defines the pouring area. The contents of the can remain exposed. The invention parts are constructed primarily of heavy gauge metal so that the invention will withstand repeated or continued use and exposure to solvents. The invention can be manufactured in sizes for use on paint cans (or other similar containers) ranging in size (capacity) from one-half pint to five gallons. The invention's design makes for quick changes from can to can and easy clean up.

1 Claim, 3 Drawing Sheets

LATCH ON PAINT CAN POUR SPROUT

BACKGROUND OF THE INVENTION

The present invention relates to painting accessories for paint cans.[1] It specifically relates to paint can pour spouts. Usually, when paint is poured from a paint can, it runs down the side of the can causing mess and inconvenience. Without a pour spout, it is also difficult to direct the contents of a can into other painting accessories or defined areas.

[1]While the term "paint can" or "can" is used in this application, the present invention can be manufactured for use on any can which employs a paint can type lid and which has a ridge around the circumference of the bottom of the can.

Prior art demonstrates devices designed to address these problems. These devices are generally made of plastic, engage a friction fit over the outer diameter of the top of the paint can rim and have a pour spout extending upward from the can. Such friction fit devices are typically difficult to attach and remove. In addition, the plastic used to construct these devices lacks durability and tends to lose integrity with repeated stretching and exposure to solvents. Also, these devices, since they employ friction fit over the entire diameter of the top of the paint can, are difficult to use with bent or damaged paint cans.

The present invention has all of the advantages of a typical paint can pour spout. However, it also has other unique advantages. It employs a simple hinged latch device to provide quick and easy attachment, unlike friction fit devices. The invention is made of metal components which makes it more durable than plastic devices. Also, the invention employs the use of only one-half of the diameter of the inner ridge at the top of the paint can, such that it can be used with damaged paint cans.

SUMMARY OF THE INVENTION

The present invention is designed to correct the problems outlined above, as they pertain to prior art. The present invention employs a pour spout that attaches directly over the inner ridge at the top of a paint can. Instead of using a friction fit ring configuration, the device uses a hinged latch mechanism to attach to the can.

The present invention consists of a metal pour spout device. The pour spout device extends outward from the can at a 45 degree angle and narrows (funnels) as it moves out from the can. This defines the pouring area. Welded to the base of the pour spout is a metal ridge grove seal device. This ridge groove seal device fits, in saddle fashion, directly over the inner ridge at the top of the can which was formally occupied by the paint can's lid. This ridge groove seal device covers one-half of the total diameter of the top ridge of the paint can. The groove portion of this device employs a synthetic rubber seal which is held in place by press fit. This seal forms a rubber barrier between the ridge at the top of the paint can, formerly occupied by the can's lid, and the surface of the ridge grove device where it comes into contact with said ridge. This synthetic rubber seal, between the ridge grove and the inner ridge at the top of the can, combined with the tension fit described below, insures that paint will not seep under the pour spout and down the side of the can, during the pouring process. When paints of different colors or other liquids are used, in conjunction with the invention, the synthetic rubber seal can be removed and cleaned or easily replaced.

The pour spout device is attached by weld to a metal brace device. The brace device runs from the under side of the spout, in parallel fashion along the side of the can, to a point exactly half way down the can's side. The bottom end of the brace connects, by means of latch wires, to a latch arm device that grasps the ridge which runs along the perimeter of the bottom of a paint can. The brace, latch wires and latch arm, in combination, comprise a latch device. When the latch device is closed, tension exists between the portion of the latch arm, holding the bottom ridge of the can and the seated ridge groove seal device at the top of the can. This tension forces the ridge groove device onto the can's inner ridge in a tight fashion. Thus, when the invention is attached (latched) on a paint can, paint can be directed through the pour spout without flowing into the can's lid groove and down the side of the can. After use, the invention can be quickly removed by unfastening the latch device. This releases the tension that holds the seated ridge groove seal device over the inner ridge at the top of the can. As the invention is comprised mostly of heavy gauge metal, it can be withstand repetitive use and cleaning with solvents, without fear of damage to the invention. Finally, as the ridge groove seal device only employs one-half of the total diameter of the top of the can, the invention can be used with damaged or bent cans.

It is thus the objective of the present invention to allow for the pouring of paint (or other liquid) from a paint can in a desired fashion without unwanted spilling or leaking. Another objective of the invention is to provide a quick, convenient method for attaching and removing a paint can pour spout. Another objective of the invention is to provide durability and integrity of form despite long, repetitive use and exposure to solvents. Another objective is to allow use of the invention, even if a portion of a paint can's lid area is bent or otherwise damaged.

These and other objectives and advantages will become apparent to those skilled in the art after considering the following detailed specification in conjunction with the drawings submitted herein.

DETAILED DESCRIPTION OF THE PREFERRED EMBODIMENT

Figure 1:
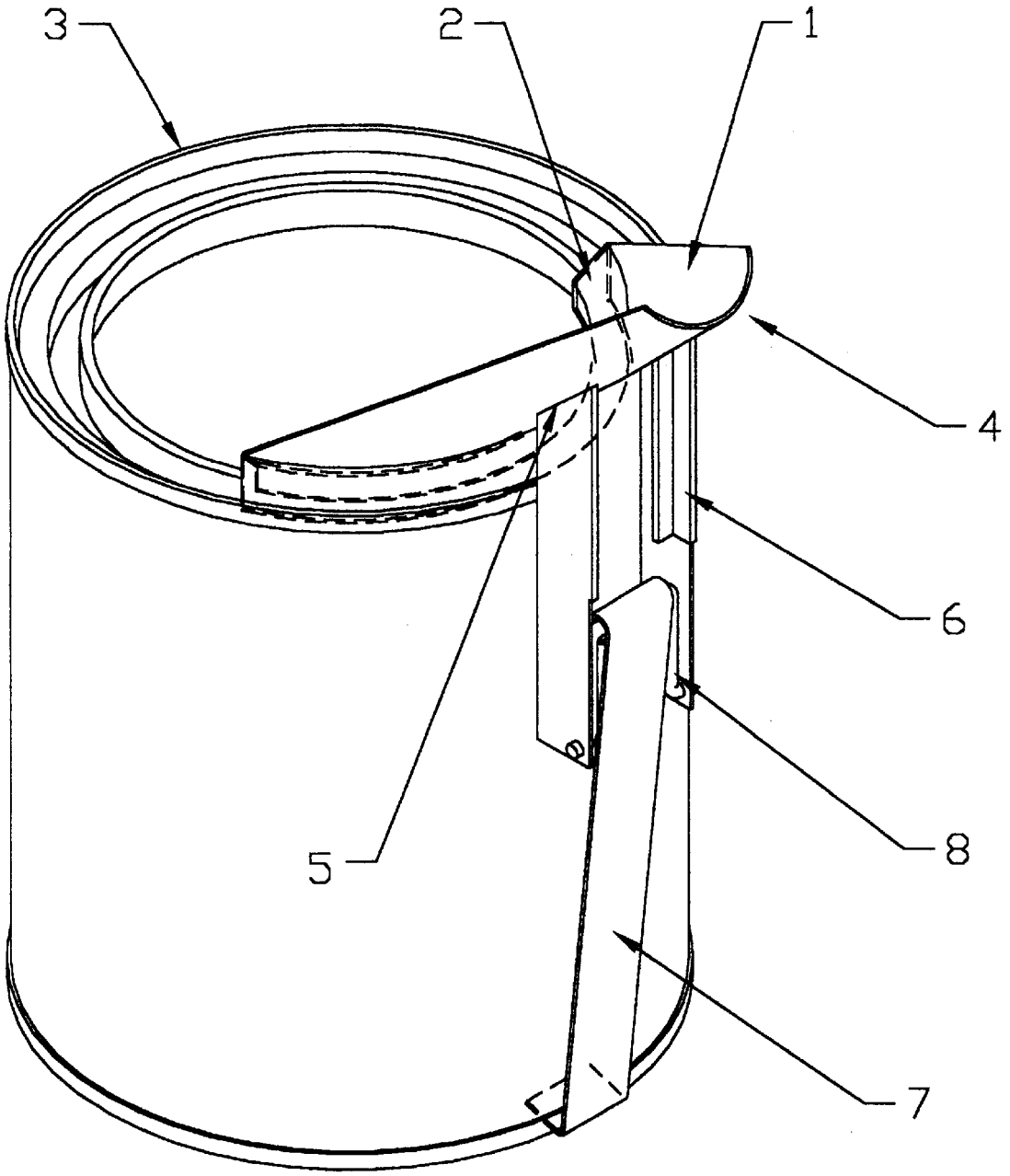
FIG. 1 is a perspective drawing of the present pour spout in the latched position.
Figure 2:
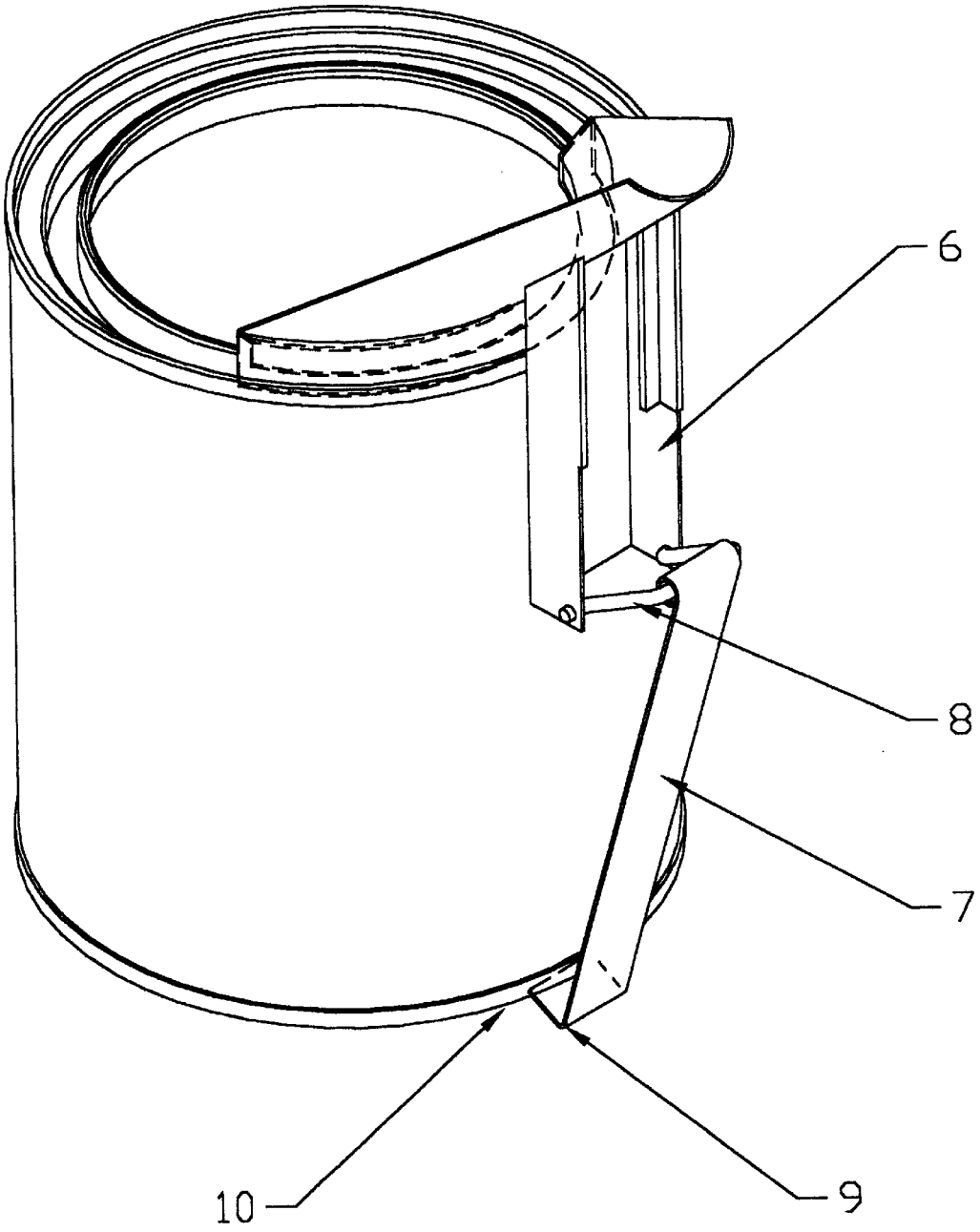
FIG. 2 is a perspective drawing of the present pour spout in the unlatched position.

Referring to the drawings, more particularly by reference numbers, wherein like numerals refer to like parts, FIG. 1 and FIG. 2 show the same perspective of the invention in two different positions of function.[2] FIG. 1 shows the invention in a latched position (attached) to a paint can. FIG. 2 shows the invention in an un-latched position. The numbers referenced in FIG. 1 are the same as they are referenced in FIG. 2. Thus, any reference to a particular number in FIG. 1 is the same as used in FIG. 2.

[2]It is respectfully requested that the drawings being submitted herewith be accepted at this time as temporary drawings only. Proper drawings will be submitted, as required by the examiner.

Number 1 in FIG. 1 identifies a metal pour spout device constructed according to the teachings of the present invention. Number 2 identifies a ridge groove seal device constructed according to the teachings of the present invention. Number 3 identifies the top ridge of a paint can formally occupied by a the paint can's lid. Number 4 identifies the end (mouth) of the pour spout device 1. Number 5 identifies the underside point of the pour spout device 1 where a brace device Number 6 joins, by weld, to the pour spout device 1.

The brace device 6 is constructed of u-channel metal. It joins the pour spout device 1 to a latch arm device Number 7 by means of a latch wires Number 8.

Welded to the base of the pour spout device 1 and is the ridge groove seal device 2. These devices, 1 & 2, are constructed from heavy gauge metal. The ridge groove seal device 2 fits, in saddle fashion, over the inner ridge at the top of a paint can formally occupied by the can's lid 3. Its length covers exactly one-half of the total diameter of the cans lid grove 3. It is curved so as to allow it to fit directly over the surface of one-half of the inner ridge at the top of a paint can 3. In other words, it is curved to the degrees necessary to allow it to fit in the can' lid grove 3.

The ridge groove seal device 2 employs a synthetic rubber seal which is held in place by press fit. This seal forms a rubber barrier between the ridge at the top of the paint can 3, and the surface of the ridge grove device 2 where it comes into contact with said ridge 3. This seal, between the ridge grove and the inner ridge at the top of the can, combined with the tension fit described below, insures that paint will not seep under the pour spout and down the side of the can.

The pour spout device 1 is a curved, tapered, fitting. It extends outward from the can at a 45 degree angle and narrows (funnels) as it moves out from the side of the can to the spout's mouth 4. Attached by weld to the center of the under side of the pour spout device 1 is a brace device 6. This brace device 6 is a one inch wide, four inch long, piece of u-channel metal. This brace device 6 runs, in parallel fashion directly next to the can's side, from the underside of the pour spout device 5 to a point exactly one-half the way down the can's side. At said point, the brace device connects to a latch arm device 7, by means of latch wires 8.

The latch wires 8 are constructed according to the teachings of the present invention. They are comprised of two heavy gauge metal wires which attach to both sides of the end of the brace device 6 and run in parallel fashion to a point where they connect in like fashion to the top end of the latch arm device 7. The latch arm device 7 is curved at the opposite end (Number 9) so that it can grasp the bottom ridge of the can Number 10. As such, when the latch device (described in detail below) is closed, tension is produced between two points, the point under the pour spout 5 and the bottom ridge of the can 10, where said ridge comes into contact with the latch arm device (i.e. the point between 9 & 10). This pulls the ridge groove seal device 2 firmly over the ridge at the top of the can 3 in a saddle fashion.

Figure 3:
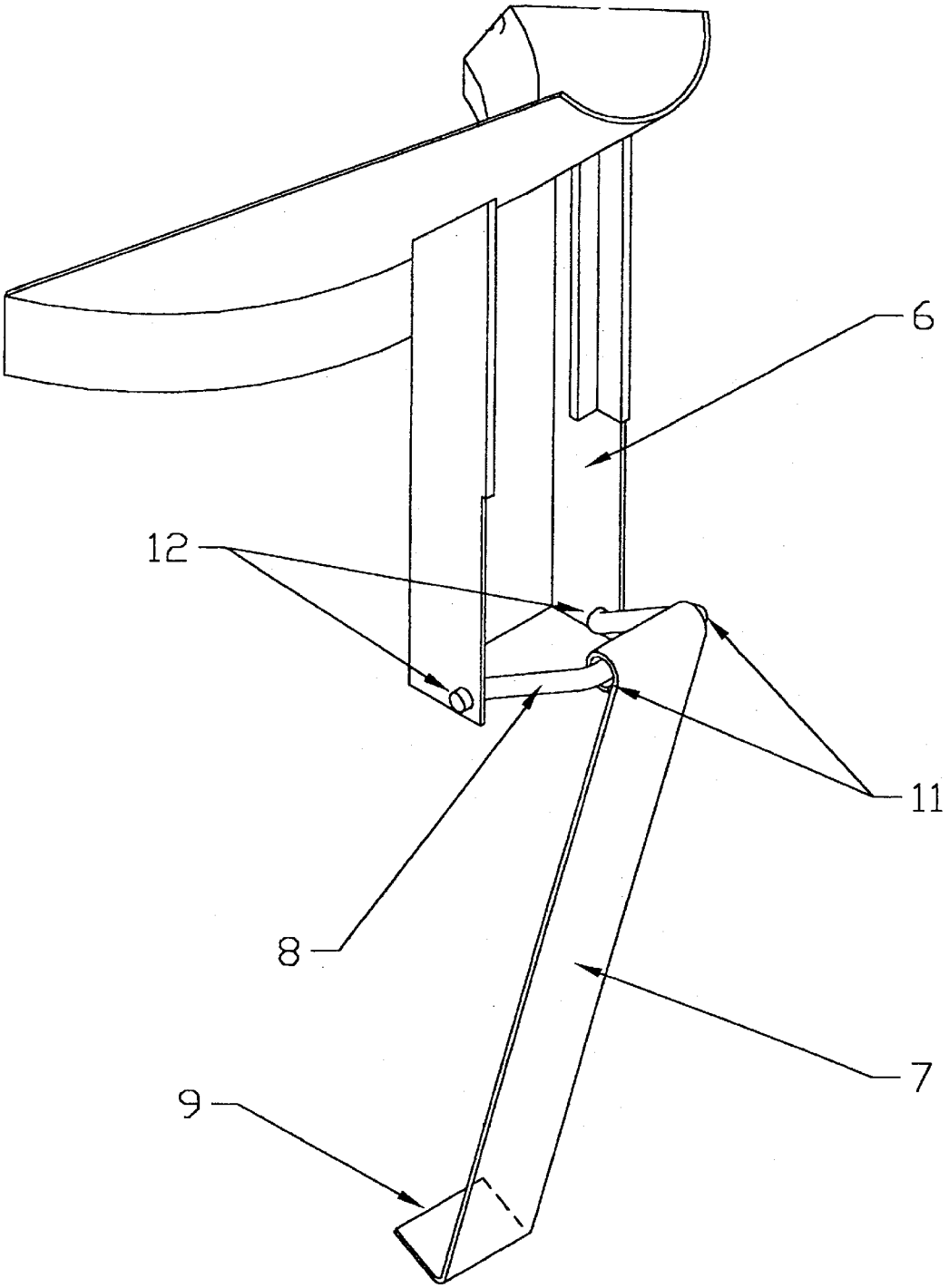
FIG. 3 is a perspective drawing of the hinged latch device.

These devices, the brace device 6, the latch wires 8 and the latch arm device 7, all form a hinged latch device as shown in FIG. 3. Referring to FIG. 3, it more specifically shows the hinge latch device. The brace device 6 is curved away from the paint can at the point where it joins with the latch wires 8. The two wires comprising the latch wires 8 are affixed to the brace device 6 by means of holes drilled through both sides of the brace device 6 through which both respective ends of the latch wires 8 pass and are secured by flattening the end of the wire (referring to Number 12). The other ends of the latch wires 8 are affixed to the latch arm device 7 in the same manner as the latch wires 8 are affixed to the brace device 6, as described above. Thus, the latch wires 8 are attached to the latch arm device 7 by means of holes drilled through both sides of the top end of the latch arm device 7, which latch wires 8 are then bent to secure (referring to Number 11).

What is claimed:

1. A latch on paint can pour spout comprising:

a pour spout, having an upper and a lower surface, oriented to extend outwardly from the upper edge of a paint can, said pour spout becoming narrower in the direction extending away from the paint can;

a ridge groove seal member attached to the lower surface of said pour spout, said ridge groove seal fitting in saddle fashion over a portion of an inner ridge at the top of the can which was formally occupied by a paint can lid;

a synthetic seal member forming a seal between said ridge groove seal member and said inner ridge at the top of the can;

an over center hinged latch device comprised of a brace member attached to the lower surface of said pour spout at one end thereof and having an aperture at an opposite end thereof, a latch arm member having a hook at one end thereof, for engaging an edge of a lower end of the paint can, and having an aperture at an opposite end thereof, and a link member pivotally connected to said apertures for attaching said brace member and said latch arm member;

wherein said over center hinged latch device secures the paint can pour spout to a paint can when attached thereto in a closed position.

* * * * *